United States Patent [19]

Dart et al.

[11] Patent Number: 4,953,743

[45] Date of Patent: Sep. 4, 1990

[54] SPLASH PROOF RAISED VENT LID

[75] Inventors: Robert C. Dart, Okemos, Mich.; John R. Darras, Leola, Pa.

[73] Assignee: Dart Container Corporation, Mason, Mich.

[21] Appl. No.: 367,602

[22] Filed: Jun. 19, 1989

[51] Int. Cl.[5] ..... B65D 51/16

[52] U.S. Cl. ..... 220/369; 220/373; 220/90.4; 339/906.1

[58] Field of Search ..... 220/90.2, 90.4, 369, 220/373, 367; 229/906.1

[56] References Cited

U.S. PATENT DOCUMENTS

| | | | |
|---|---|---|---|
| 2,414,697 | 1/1947 | Pettersson | 229/13 |
| 3,048,317 | 8/1962 | Cochrane et al. | 220/90.2 |
| 3,206,059 | 9/1965 | Fead et al. | 229/906.1 |
| 3,335,897 | 8/1967 | Castro | 220/373 |
| 3,421,681 | 1/1969 | Frank | 229/43 |
| 3,557,995 | 1/1971 | Mirasol | 220/42 |
| 3,727,808 | 4/1973 | Fitzgerald | 222/482 |
| 3,805,991 | 4/1974 | Cheladze et al. | 220/373 |
| 4,026,459 | 5/1977 | Blanchard | 229/906.1 |
| 4,141,462 | 2/1979 | Rucci | 220/367 |
| 4,394,928 | 7/1983 | Philip | 220/366 |
| 4,412,629 | 11/1983 | Dart et al. | 220/90.4 |
| 4,428,498 | 1/1984 | Obey | 220/367 |
| 4,503,992 | 3/1985 | Sitko et al. | 229/906.1 |
| 4,512,497 | 4/1985 | Grusin | 220/367 |
| 4,582,214 | 4/1986 | Dart et al. | 220/90.4 |
| 4,756,440 | 7/1988 | Gartner | 220/90.4 |

FOREIGN PATENT DOCUMENTS

| | | | |
|---|---|---|---|
| 763263 | 7/1967 | Canada | 220/373 |

*Primary Examiner*—David T. Fidei

*Attorney, Agent, or Firm*—Miller, Morriss and Pappas

[57] ABSTRACT

A lid for use on a drinking cup is provided having a central horizontal cover portion which has a vent means provided therein. The vent means comprise a circular, horizontal top portion having a vent opening therethrough. The top portion has a downwardly depending first wall which has terminal end below the surface of the cover portion. An upwardly extending second wall merges with the terminal end of the first wall and extends upwardly therefrom in an outwardly spaced apart position respect thereto so as to merge with the cover portion of the lid. A plurality of spaced apart ribs connect the first wall and the second wall so as to cooperate therewith the form downwardly depending arcuate wave dampening baffle means which encircle the vent means beneath the surface of the cover portion so as to prevent accidental spillage of the cup contents through the vent means.

4 Claims, 3 Drawing Sheets

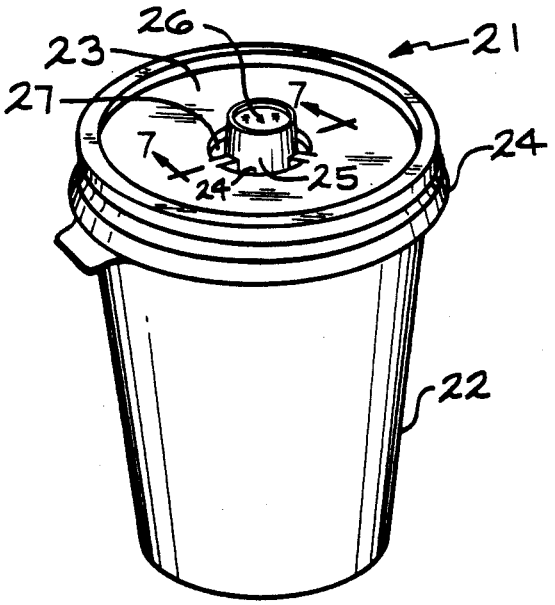
FIG. 1
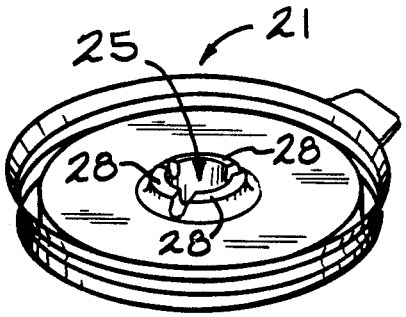
FIG. 2
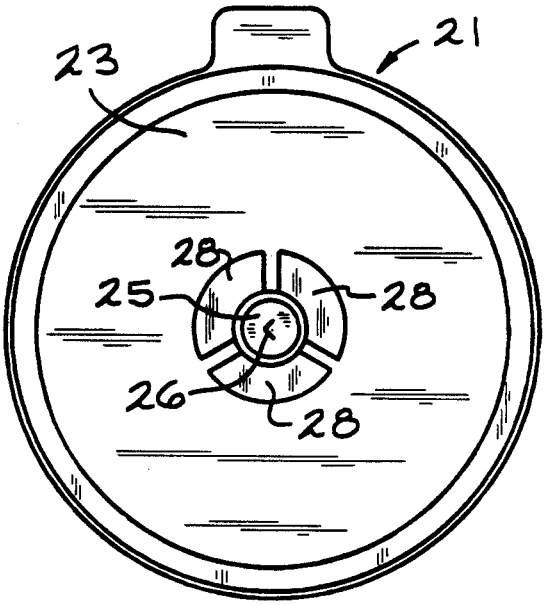
FIG. 3
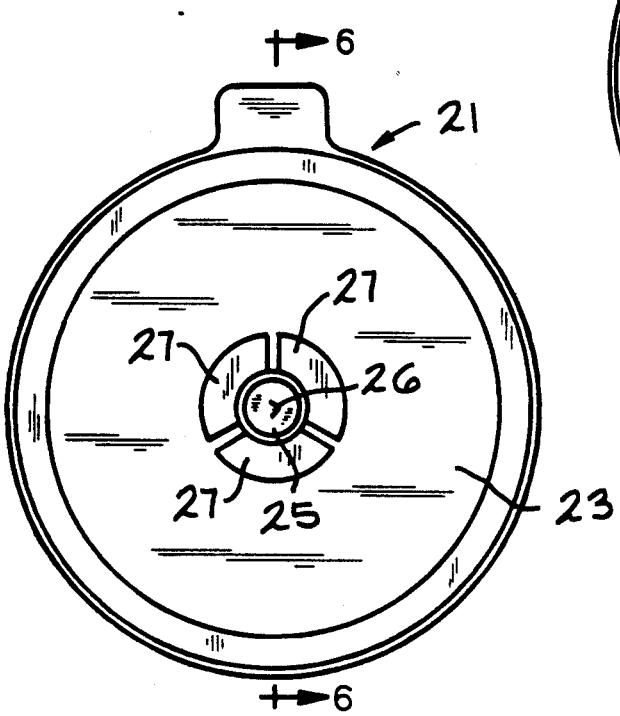
FIG. 4
FIG. 5
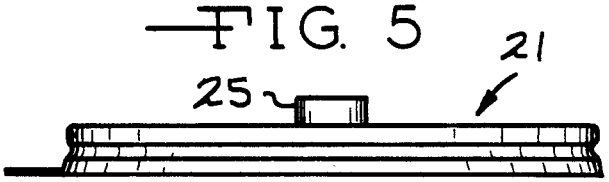

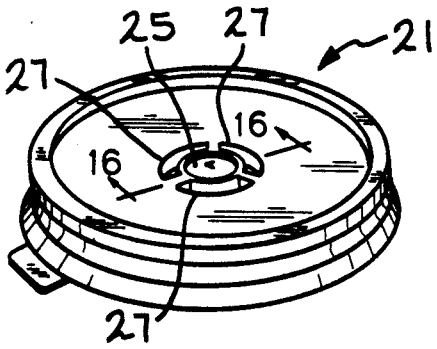
FIG. 11
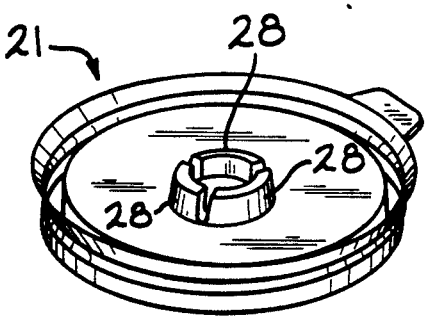
FIG. 12
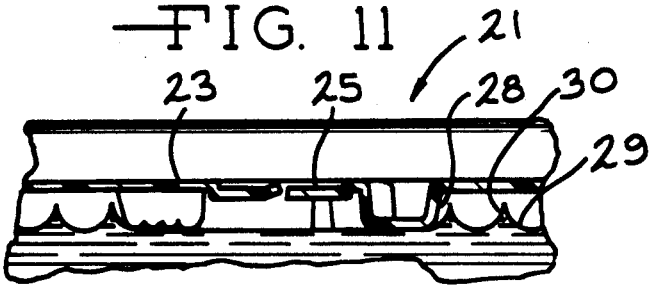
FIG. 16
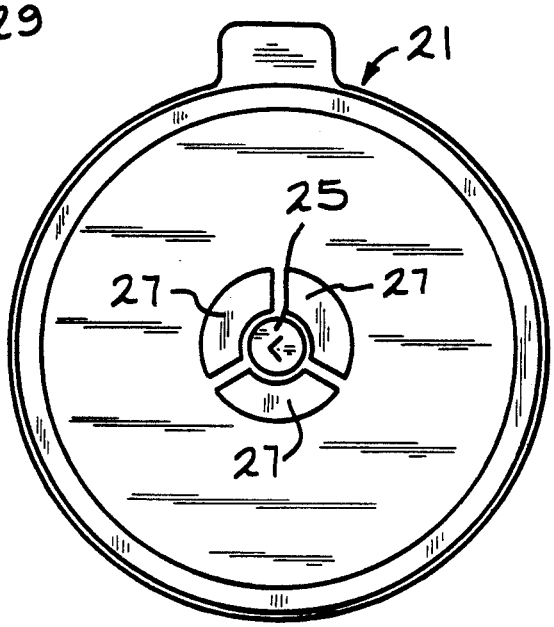
FIG. 13
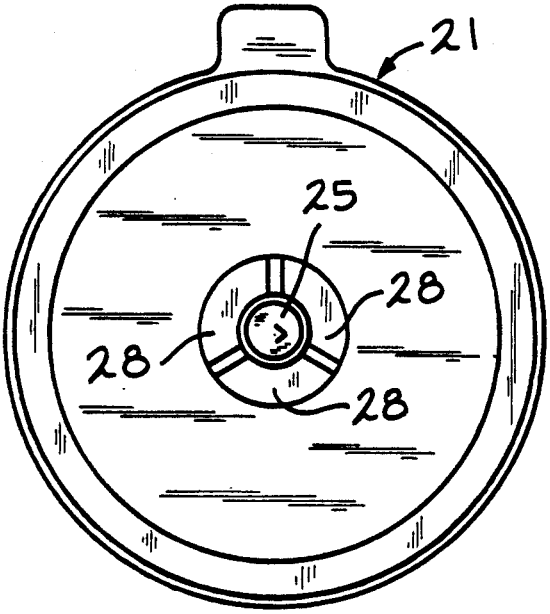
FIG. 15
FIG. 14
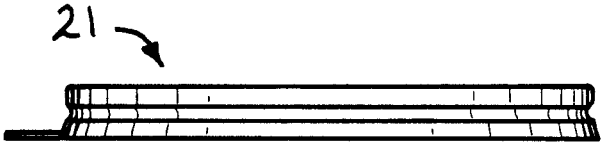

SPLASH PROOF RAISED VENT LID

This invention relates to a splash proof raised vent lid for use on drinking cups and containers. More specifically, the lid is provided with a central cover portion having a plurality of downwardly depending spaced apart channel portions provided therein so as to define a plurality of wave dampening baffles extending below the surface of the lid around the base of the raised vent pedestal. The upwardly extending hollow pedestal vent member having a vent opening at the top thereof is provided so as to extend upwardly from the lowermost inner portion of the wave dampening baffles to a point above the surface of the lid.

Thus configured, the downwardly extending wave dampening baffles act to dampen the waves or splashing of the contents of the cup caused by inadvertent movement of the cup by the user. The dampening action of the downwardly depending baffles thus acts to minimize accidental splash actuated-spillage of the contents of the cup through the vent opening.

While the preferred embodiment of the lid utilizes downwardly depending circle-oriented arcuate wave dampening baffles, it is within the scope of the invention to utilize straight wave dampening baffles which are oriented about the vent opening in a triangular, square or any other configuration.

While the preferred embodiment of the invention utilizes a raised vent pedestal which extends upwardly above the upper surface of the lid cover portion, other embodiments of the invention utilize a vent pedestal which extends upwardly to the upper surface of the lid or even slightly below the surface thereof. In any of such embodiments of the invention, the downwardly depending wave dampening baffles act to eliminate or minimize the undesireable splashing action of the contents of the cup in the vicinity of the vent pedestal which in turn results in accidental spillage through the vent opening.

None of the devices of the prior known art teach the use of a lid provided with downwardly extending wave dampening baffles which surround the base of the raised vent pedestal so as to dampen the undesirable wave action or splashing which results in inadvertent spillage through the vent opening.

It is therefore an object of this invention to provide a splash proof lid for cups which eliminates or minimizes inadvertent spillage of the contents of the cup through the vent opening provided in the lid.

Another object of this invention is to provide a splash proof lid having a vent pedestal which has downwardly extending wave dampening baffles around the base thereof so as to prevent inadvertent splash-actuated spillage through the lid vent opening.

Another object of this invention is to provide a splash proof lid which has downwardly depending circle-oriented arcuate wave dampening baffles which eliminate or minimize splashing in the vent pedestal area of the lid.

Other objects and advantages found in the construction of the invention will be apparent from a consideration of the following specification in connection with the appended claims and the accompanying drawings.

IN THE DRAWINGS

FIG. 1 is a perspective view of the splash proof raised vent lid in its operative use position on a cup and showing the pedestal vent member with downwardly depending wave dampening baffle forming arcuate channel portions positioned therearound.

FIG. 2 is a bottom perspective view of the splash proof raised vent lid showing the wave dampening baffles provided around the base of the pedestal vent member.

FIG. 3 is a bottom view of the splash proof raised vent lid.

FIG. 4 is a top view of the splash proof raised vent lid.

FIG. 5 is a side elevation view of the splash proof raised vent lid.

FIG. 11 is a top perspective view of another embodiment of the splash proof raised vent lid wherein the pedestal vent does not extend above the upper surface of the lid.

FIG. 12 is a bottom perspective view of the lid embodiment of FIG. 11 and showing the arcuate wave dampening baffles depending downwardly from the bottom surface thereof.

FIG. 13 is a top view of the embodiment of the lid shown in FIG. 11.

FIG. 14 is a side elevation view of the lid shown in FIG. 11.

FIG. 15 is a bottom view of the lid shown in FIG. 11.

FIG. 16 is a partial cross-sectional schematic view taken on line 16—16 of FIG. 11.

DESCRIPTION

Figure 6:
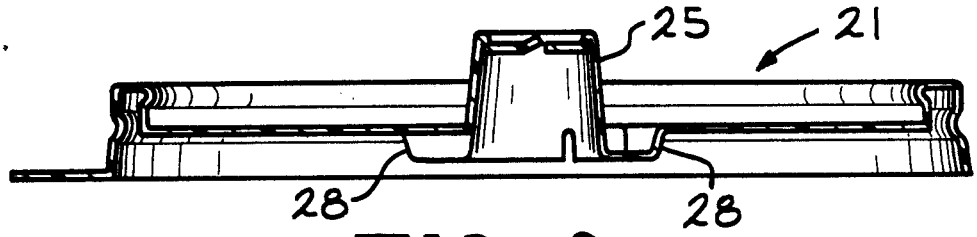
FIG. 6 is a cross-sectional view of the splash proof raised vent lid taken on line 6—6 of FIG. 4.

As shown generally in the drawings and more specifically in FIG. 1, a splash proof raised vent lid 21 is provided for selective use upon a drinking cup. Although the preferred embodiment of the lid 21 is vacuum formed from a thin sheet of plastic material, it is within the scope of the invention that the lid 21 can be selectively fabricated from paper products or other suitable composite material. Similarly the cup 22 can be of the insulating type formed by foamable plastic material or can be fabricated from paper or other suitable composite material. It should also be noted that the cup 22 can be of any standard type known in the art and is not considered to be a part of this invention.

The lid 21 is circular in shape and adapted to matingly engage the upper edge of a drinking cup 22 so as to cover the open end of the cup 22 as shown in FIG. 1. The lid 21 consists of a central cover portion 23 and a downwardly depending outwardly curved annular skirt 24. The skirt 24 is not deemed to be a part of the invention disclosed and claimed herein. The outer peripheral edge of the lid 21 is configured to make selective snapengagement with the upper edge of the cup 22 so as to effect selective closure thereof in the manner well known in the prior art.

As shown in FIG. 1, a hollow vent pedestal 25 is formed in the cover portion 23 of the lid 21 and is provided with a vent opening 26 at the top thereof. A plurality of circle oriented spaced apart arcuate channel portions 27 are provided in the surface of the lid around the base of the vent pedestal 25. As shown in bottom perspective view of FIG. 2, the arcuate channel portions 27 define a plurality of downwardly depending wave dampening arcuate baffles 28 around the base of the vent pedestal 25. The bottom of FIG. 3 further shows the lid 21 with the arcuate wave dampening baffles 28 in their wave dampening position around the raised vent pedestal 25. The top view of FIG. 4 further shows the lid 21 with the arcuate channels 27 around the raised vent pedestal 25 so as to form the arcuate wave dampening baffles 28 described above. The side elevation view of FIG. 5 shows the raised view pedestal 25 extended above the surface of the lid 21. However, as shown in FIGS. 10 through 15, it is within the scope of the invention that the vent pedestal 25 can only extend to the upper surface of the lid 21 or even to a position slightly therebelow.

As shown in the cross-sectional view of FIG. 6, the arcuate wave dampening baffles 28 extend downwardly below the surface of the cover portion 23 of the lid 21 and around the base of the vent pedestal 25.

Figure 7:
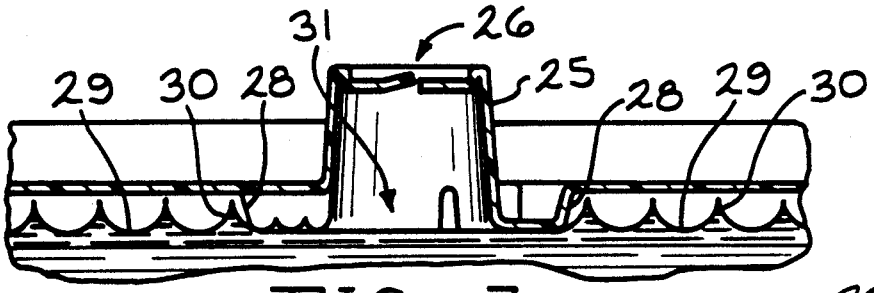
FIG. 7 is a cross-sectional schematic view of the splash proof raised vent lid showing the wave dampening effect of the downwardly depending wave dampening baffles upon the contents of the cup directly below the raised pedestal vent member.

With the lid 21 in its operative use position on a cup 22, the arcuate wave dampening baffles 28 extend downwardly into contact with the splashing contents of the liquid 29 contained within the cup 22. As shown in FIG. 7, the baffles 28 provide a wave dampening effect on the splash actuated waves 30 so as to maintain a relatively calm surface 31 in the areas beneath the vent pedestal 25 so as to prevent spillage of the liquid 29 through the vent opening 26.

Figure 8:
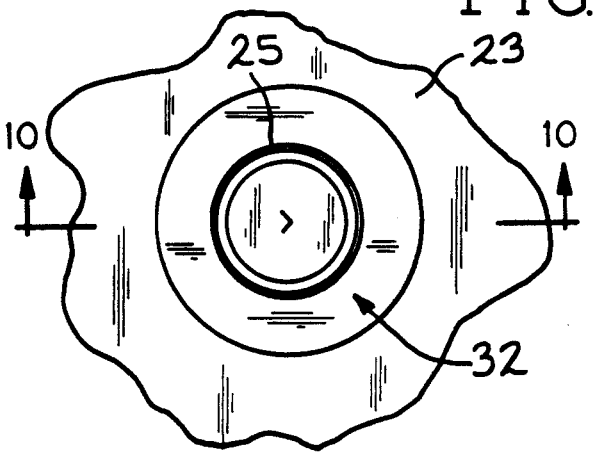
FIG. 8 is a partial schematic top view of another embodiment of the splash proof raised vent lid showing a continuous circular baffle forming channel formed around the base of the raised pedestal vent.
Figure 9:
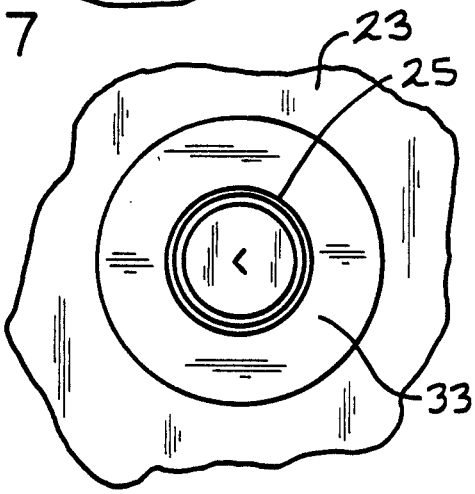
FIG. 9 is a partial schematic bottom view of the splash proof vent member shown in FIG. 8.
Figure 10:
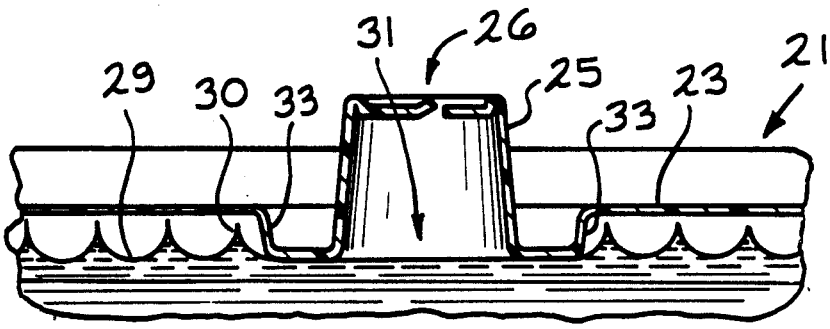
FIG. 10 is a cross-sectional schematic view taken on line 10—10 of FIG. 8 showing the continuous circle baffle extending downwardly around the base of the raised pedestal vent.

As shown in FIGS. 8 through 10, it is within the scope of the invention to merge the arcuate channels 27 in the preferred embodiment shown in FIG. 1 through 7 so as to provide a continuous dampening baffle 33 extending downwardly around the base of the vent pedestal as shown in FIG. 10. The wave dampening baffle 33 acts to prevent or minimize spillage through the vent opening as previously described. As stated previously, the embodiment of the lid 21 shown in FIGS. 11 through 16 is the same as the preferred embodiment shown in FIGS. 1 through 7 with the modification of the vent pedestal 25 so that it does not extend above the upper surface of the lid 21.

It should be noted that this lid invention which incorporates the concept of a vent member 25 which is surrounded by downwardly depending wave dampening baffles or a continuous baffle 33 around the base thereof can be utilized with drink-through lids which are well known in the art. Such lids utilize depressible tabs or tear-out tabs to permit the user to drink from the cup with out removing the lid from the cup.

In summary, a splash proof lid is provided for use on a drinking cup. The splash proof lid has a central cover portion. The lid is adapted to matingly engage the upper peripheral edge of a drinking cup so as to selectively maintain the lid in a covering relationship on said cup. Vent means are provided in the cover portion and wave dampening baffle means are provided thereon so as to extend downwardly from the cover portion. The wave dampening baffle means are positioned around the vent means so as to minimize splashing of the cup contents therebelow to prevent accidental spillage through the vent means. In one embodiment of the splash proof lid, the vent means comprise a raised pedestal vent. The wave dampening baffle means have a longitudinally arcuate configuration. In one embodiment of the invention, the wave dampening baffle means comprise downwardly depending spaced apart circle-oriented wave dampening baffles which encircle the vent below the surface of the cover portion. In another embodiment of the invention, the wave dampening baffle means comprises a continuous downwardly depending circular wave dampening baffle which encircles the vent means below the surface of the cover portion. In yet another embodiment of the invention, the downwardly depending wave dampening baffle means surround the vent means in a triangular configuration. In still another embodiment of the invention, the downwardly depending wave dampening baffle means surround the vent means in a square configuration.

Various other modifications of the invention may be made without departing from the principle thereof. Each of the modifications is to be considered as included in the hereinafter appended claims unless these claims by their language expressly provide otherwise.

We claim:

1. A splash proof lid for use on a drinking cup comprising:

a lid having a central horizontal cover portion, said lid adapted to matingly engage the upper peripheral edge of a drinking cup so as to selectively maintain said lid in a covering relationship on said cup;

vent means provided in said cover portion, said vent means comprising a circular, horizontal top portion with a vent opening therethrough;

a first wall depending downwardly from the perimeter of said top portion, said first wall having a terminal end below the surface of said cover portion;

a second wall merged with the terminal end of said first wall, said second wall extending upwardly in an outwardly spaced apart relationship to said first wall so as to merge with the said horizontal cover portion;

a plurality of spaced apart radially extending ribs connecting said first wall and said second wall, said ribs cooperating with said first wall and said second wall to define downwardly depending arcuate wave dampening baffle means which encircle said vent means below said cover surface in close proximity thereto so as to minimize splashing of the cup contents below said lid so as to prevent accidental spillage through said vent means.

2. In the splash proof lid of claim 1 wherein said vent means comprise a raised pedestal vent.

3. In the splash proof lid of claim 1 wherein said wave dampening baffle means have a longitudinally arcuate configuration.

4. In the splash proof lid of claim 1 wherein said wave dampening baffle means comprise downwardly depending spaced apart circle-oriented wave dampening baffles which encircle said vent means below the surface of said cover portion.

* * * * *